US009938052B2

(12) United States Patent
Dabbur

(10) Patent No.: US 9,938,052 B2
(45) Date of Patent: Apr. 10, 2018

(54) SAFETY MECHANISM FOR CONTAINERS

(71) Applicant: SEALTAP GMBH, Zug (CH)

(72) Inventor: Ismail Omar Dabbur, Jaffa of Nazareth (IL)

(73) Assignee: SEALTAP GMBH, Zug (CH)

( * ) Notice: Subject to any disclaimer, the term of this patent is extended or adjusted under 35 U.S.C. 154(b) by 0 days.

(21) Appl. No.: 14/799,868

(22) Filed: Jul. 15, 2015

(65) Prior Publication Data

US 2016/0236831 A1 Aug. 18, 2016

Related U.S. Application Data

(63) Continuation-in-part of application No. 14/623,742, filed on Feb. 17, 2015, now Pat. No. 9,682,797.

(51) Int. Cl.

| | |
|---|---|
| ***B65D 47/08*** | (2006.01) |
| ***B65D 43/20*** | (2006.01) |
| ***B65D 43/02*** | (2006.01) |
| ***B65D 51/18*** | (2006.01) |
| ***B65D 17/00*** | (2006.01) |

(52) U.S. Cl.

CPC ..... *B65D 43/20* (2013.01); *B65D 17/161* (2013.01); *B65D 17/163* (2013.01); *B65D 17/165* (2013.01); *B65D 43/02* (2013.01); *B65D 51/18* (2013.01); *B65D 2101/0092* (2013.01); *B65D 2251/009* (2013.01);

(Continued)

(58) Field of Classification Search

CPC ..... B65D 43/20; B65D 43/02; B65D 51/18; B65D 2251/0018; B65D 2251/0028; B65D 2251/009; B65D 2251/0081; B65D 2517/0011; B65D 2517/0014; B65D 2517/0016; B65D 2517/0041;

(Continued)

(56) References Cited

U.S. PATENT DOCUMENTS

| | | | | |
|---|---|---|---|---|
| 4,170,724 A * | 10/1979 | Waterbury | ..... | B65D 17/506 206/807 |
| 4,214,672 A | 7/1980 | Peniche | | |
| 4,537,326 A | 8/1985 | Morehead | | |
| 4,749,099 A * | 6/1988 | Davis | ..... | B65D 17/165 220/265 |
| 4,989,746 A * | 2/1991 | Pierce | ..... | B65D 51/007 220/254.3 |

(Continued)

FOREIGN PATENT DOCUMENTS

| | | |
|---|---|---|
| CN | 203682067 U | 7/2014 |
| ES | 1046776 Y | 7/2001 |

(Continued)

*Primary Examiner* — J. Gregory Pickett
*Assistant Examiner* — Elizabeth Volz
(74) *Attorney, Agent, or Firm* — Browdy and Neimark, PLLC

(57) ABSTRACT

A container top comprising a container top member comprising tracks over an upper surface thereof and a sealer sealing an opening thereof; and a slidable member having a sealing mechanism, the slidable member being slidable through the tracks and positioned such that sliding of the slidable member over the tracks to one direction unseals the sealer, forming an opening over the container top member, in the initial opening thereof and wherein sliding the slidable member back to its original position over the opening formed thereby covers and seals the opening. The opening formed by the unsealing of the sealer can be re-sealed at will by the sealing mechanism of the slidable member. The sealing mechanism may be for example a sealing material coating strip located over a periphery of the slidable member or the physical configuration of the slidable member periphery edges.

11 Claims, 19 Drawing Sheets

(52) U.S. Cl.
CPC ..... *B65D 2251/0018* (2013.01); *B65D 2251/0028* (2013.01); *B65D 2251/0081* (2013.01); *B65D 2517/0011* (2013.01); *B65D 2517/0014* (2013.01); *B65D 2517/0016* (2013.01); *B65D 2517/0041* (2013.01); *B65D 2517/0098* (2013.01)

(58) Field of Classification Search
CPC ..... B65D 2517/0098; B65D 17/161; B65D 17/163; B65D 17/165
USPC ... 220/254.1, 254.9, 269, 345.6, 345.1, 713, 220/812
See application file for complete search history.

(56) References Cited

U.S. PATENT DOCUMENTS

| | | | | |
|---|---|---|---|---|
| 5,129,541 | A * | 7/1992 | Voigt | B65D 17/165 220/269 |
| 5,285,924 | A | 2/1994 | Morris | |
| 7,025,224 | B2 | 4/2006 | Coleman | |
| 7,222,746 | B2 | 5/2007 | Eckstrum | |

FOREIGN PATENT DOCUMENTS

| | | | |
|---|---|---|---|
| JP | 6219448 | A | 8/1994 |
| JP | 7132937 | A | 5/1995 |
| JP | 2002104472 | A | 4/2002 |
| WO | 2013062062 | A1 | 5/2013 |
| WO | 2013124019 | A2 | 8/2013 |

* cited by examiner

SAFETY MECHANISM FOR CONTAINERS

FIELD OF THE INVENTION

The present invention generally relates to mechanisms for sealing containers and more particularly to mechanisms for safety sealing and covering of containers allowing repeatable covering and opening of a container's opening especially yet not exclusively for food and beverages containers.

BACKGROUND OF THE INVENTION

Manufacturers of food and beverage cans typically use pull-tab sealing and opening mechanism or stay-on tabs, in which a tab is used to tear off the can top (full aperture end) or designated part thereof for leaving an opening at the can top. In the pull tab mechanism the tab is removed from the can whereas in the stay-on tab the tab remains after the opening is revealed.

Other solutions involve press button mechanisms, in which a designated opening in the can upper face is sealed by using soft connection of the sealer to the opening rim requiring pressing the softly connected seal downwards towards the inner space of the can for opening thereof.

These solutions are vulnerable to unauthorized penetration to the inner cavity of the containers after filling and sealing thereof by the manufacturer and enable insertion of materials into the containers while covering any trace of the penetration. For example, in the case of the pull-tab or stay-on tab sealing the tab connects to the top of the container usually through a connecting stud and can be easily rotated around the stud axis revealing some of the upper surface exposed for injecting a material into the can or even replacing the liquid in the can with a different liquid and covering the area of the penetration hole by rotating the tab back to its position again. In this way the user of the can cannot see that the can was "treated" and might innocently use it for drinking or for eating the food content thereof.

SUMMARY OF THE INVENTION

The present invention provides a container top comprising a container top member comprising tracks over an upper surface thereof and a sealer sealing an opening thereof; and a slidable member having a sealing mechanism, the slidable member being slidable through the tracks and positioned such that sliding of the slidable member over the tracks to one direction unseals the sealer, forming an opening over the container top member, in the initial opening thereof and wherein sliding the slidable member back to its original position over the opening formed thereby covers and seals the opening. The opening formed by the unsealing of the sealer can be re-sealed at will by the sealing mechanism of the slidable member. The sealing mechanism may be for example a sealing material coating strip located over a periphery of the slidable member or the physical configuration of the slidable member periphery edges.

According to some embodiments, the sealing mechanism comprises a sealing coating strip or sealing material strip connected to a lower periphery of the slidable member.

According to some embodiments, the slidable member periphery is curved such as to allow engagement thereof with the tracks and upper surface of the container top for sealing thereof. The slidable member periphery curving, in some embodiments, forms and angle fit to have the periphery edge to engage the tracks.

According to some embodiments, the sealer has a sloped protruding shape and the slidable member has a complimentary sloped protrusion configured for fitting to the sealer for covering the sealer in the initial sealed position and pushing thereof inwardly towards the interior of the can for opening thereof.

The slidable member may further comprise at least one protruding stripe.

The container top according to claim 1, wherein said tracks and sealer are produced through punch pressing. According to some embodiments, the sealer is a press button sealer configured for sealing the opening of the container by loosely connecting to the edges of said opening.

The container top is optionally configured for sealably attaching thereof to a container body containing a material therein.

The present invention further provides a sealing and safety mechanism for a can container positionable over a container top and part thereof, the mechanism comprising: at least two tracks positioned over an upper surface of the container top; a sealer sealing an opening over the container top; and a slidable member having a sealing mechanism, the slidable member being slidable through the tracks and positioned such that sliding of the slidable member over the tracks to one direction unseals the sealer, forming an opening over the container top member, in the initial opening thereof and wherein sliding the slidable member back to its original position over the opening formed thereby covers and seals the opening.

BRIEF DESCRIPTION OF THE DRAWINGS

FIG. 1A shows a perspective view of the can having a press button sealer and the tracks of the safety cover mechanism formed by punch pressing of the upper surface part of the can; FIG. 1B shows a perspective view of the can and the slidable member of the safety cover mechanism in a closed position in which the slidable covers the press button of the can; FIG. 1C shows a perspective view of the can and safety cover mechanism, wherein the slidable member is in a semi-closed position slightly pushing the press button inwardly towards the inner cavity of the can for detaching part thereof to allow opening thereof; FIG. 1D shows a perspective view of the can and safety cover mechanism, wherein the slidable member is in a semi-closed position further pushing the press button inwardly towards the inner cavity of the can for detaching part thereof to allow opening thereof; FIG. 1E shows a perspective view of the can and safety cover mechanism, wherein the slidable member is in an open position in which the press button of the can is completely pressed inwardly leaving an open hole at the can upper face; and FIG. 1F shows a cross sectional view of the upper part of the can with the slidable member shown inside the tracks of the safety cover mechanism.

FIG. 2A shows a perspective view of the can and safety cover mechanism, in which the slidable member and the flexible sealer are in a sealed closed position covering the press button that seals the opening of the can; FIG. 2B shows a perspective view of the can and the safety cover mechanism, wherein the slidable member is slid backwards to reveal the flexible sealer and the flexible sealer is in a covering position in which it covers the can top rim part; FIG. 2C shows a perspective view of the can and the safety cover mechanism, wherein the slidable member is in an open position and the flexible sealer is slightly lifted revealing that the press button of the can is fully pushed inwardly opening the can top hole; FIG. 2D shows a perspective view of the can and the safety cover mechanism, wherein the slidable member is in a fully open position and the flexible sealer is fully removed; and FIG. 2E shows a cross sectional view of the upper part of the can with the slidable member shown inside the tracks of the safety cover mechanism.

FIG. 3A shows a perspective view of the can and safety cover mechanism, in which the slidable member is in a closed position covering the press button sealer that seals the opening of the can; FIG. 3B shows a perspective view of the can and the safety cover mechanism, wherein the slidable member is in a semi-open position slightly pushing the press button sealer inwardly into the can; FIG. 3C shows a perspective view of the can and the safety cover mechanism, wherein the slidable member is in a fully open position and the press button is fully inserted into the can or dropped therein; FIG. 3D shows a perspective view of the slidable member of the safety cover mechanism; and FIG. 3E shows a cross sectional view of the upper part of the can with the slidable member shown inside the tracks of the safety cover mechanism.

FIG. 4A shows a perspective view of the can and safety cover mechanism, in which the slidable member and flexible sealer are in closed position; FIG. 4B shows a perspective view of the can and the safety cover mechanism wherein the slidable member is in an open position and the flexible sealer is in a closed position; FIG. 4C shows a perspective view of the can and the safety cover mechanism, wherein the slidable member is in an open position and the flexible sealer is slightly lifted to remove thereof for using the can for drinking therefrom; FIG. 4D shows a perspective view of the can and the safety cover mechanism, wherein the slidable member is in a fully open position and the flexible sealer is fully removed; and FIG. 4E shows a cross sectional view of the upper part of the can with the slidable member shown inside the tracks of the safety cover mechanism.

FIG. 5A shows a perspective view of the can and safety cover mechanism, wherein the tracks of the safety cover mechanism protrude from the upper surface part of the can; FIG. 5B shows a perspective view of the can and the flexible sealer of the safety cover mechanism in a closed position in which the flexible sealer seals the opening of the can and covers a rim portion thereof designated to be in contact with a user's lips from drinking beverage content of the can; FIG. 5C shows a perspective view of the can and safety cover mechanism, wherein the slidable member is in a semi-closed position slightly tearing off a softly connected sealing part of the flexible sealer; FIG. 5D shows a perspective view of the can and safety cover mechanism, wherein the slidable member is in a fully open position revealing the sealing opening of the flexible sealer while maintaining part of the sealer over the can rim portion that is to be in contact with the user's lips; FIG. 5E shows a perspective view of the can and safety cover mechanism, wherein the slidable member is in an open position and the flexible sealer is semi-removed at least from the rim portion it covered; FIG. 5F shows a perspective view of the can and safety cover mechanism in a fully open position with the flexible sealer fully removed therefrom; and FIG. 5G shows a cross sectional view of the upper part of the can with the slidable member shown inside the tracks of the safety cover mechanism.

FIG. 6A shows a top view of the can and safety mechanism; FIG. 6B shows a cross sectional side view of the can and safety mechanism; and FIG. 6C shows a perspective view of the can and safety mechanism.

FIG. 10A shows a perspective exploded view of the safety mechanism integrated with the can top; FIG. 10B shows a bottom perspective view of the slidable member of the safety mechanism; FIG. 10C shows a bottom view of the can top with the sealer push button and tracks integrated therein; and FIG. 10D shows a can having the can top thereover, wherein the slidable member and sealer are in a semi-open position.

FIG. 11A shows a perspective exploded view of the safety mechanism integrated with the can top; FIG. 11B shows a perspective elevated view of the slidable member of the safety mechanism also serving as a sealer; FIG. 11C shows an elevated bottom view of the slidable member; FIG. 11D shows an elevated view of the slidable member indicating a position for cross-section cutting DD; FIG. 11E shows a sectional view of DD ; FIG. 11F shows a zoom-in area E of the cross sectional view DD of the safety mechanism.

DETAILED DESCRIPTION OF SOME EMBODIMENTS OF THE INVENTION

Figure 1A:
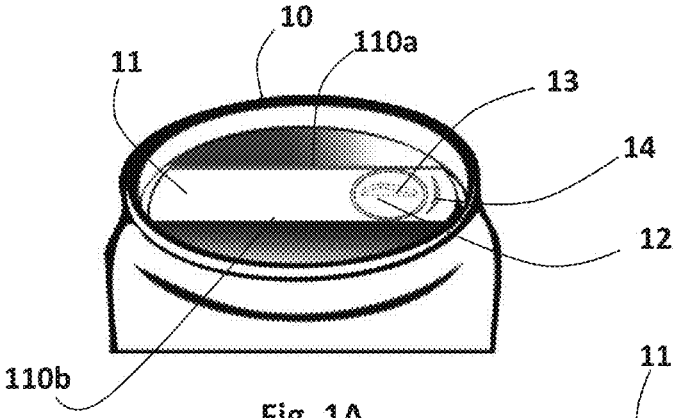
FIGS. 1A-1F schematically illustrate a safety cover mechanism for a conical can container having a press button sealer, wherein the safety cover mechanism has a slidable member slidable over designated tracks, according to some embodiments of the present invention.
Figure 1B:
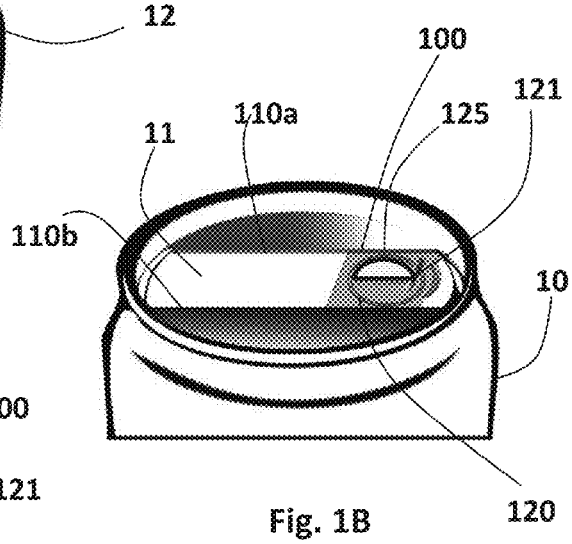
Figure 1C:
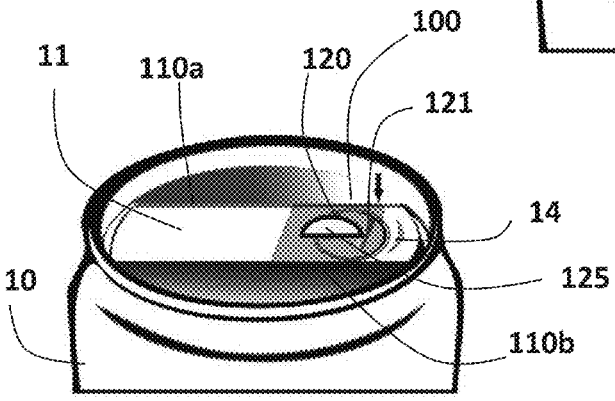
Figure 1D:
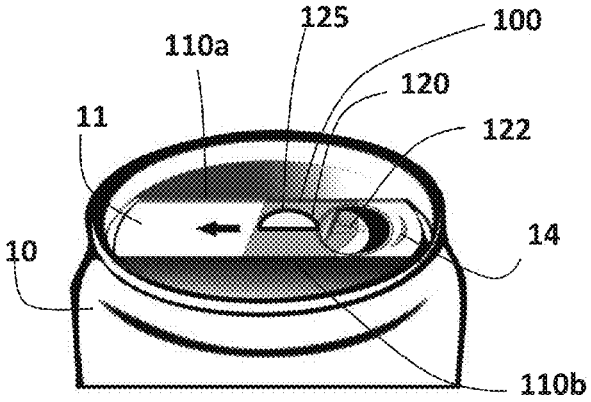

In the following detailed description of various embodiments, reference is made to the accompanying drawings that form a part thereof, and in which are shown by way of illustration specific embodiments in which the invention may be practiced. It is understood that other embodiments may be utilized and structural changes may be made without departing from the scope of the present invention.

The present invention, in some embodiments thereof, provides a safety cover mechanism for containers such as food or beverages cans or any other container. The safety cover mechanism is designed to prevent unauthorized and unnoticed penetration to the inner cavity of the container by only enabling accessing the content of the container through the mechanism, which will always leave a visible trace to the opening or any other treatment thereof.

According to some embodiments, the safety cover mechanism comprises at least one track positionable over a top part of the container in proximity to an opening thereof, which may be sealed by a sealer softly connected to edges of the opening; and a slidable member slidable over the at least one track such as to allow covering and revealing the container opening by sliding the slidable member along the one or more tracks. The one or more tracks may be designed as an integral part of the container top or connected thereto. The slidable and track design does not enable any part of the upper surface of the container to be exposed and then constantly covered during opening of the container, since the slidable has to be moved along the one or more tracks for repeatedly revealing and covering the opening thereof. This leaves out the pull or stay-on tab solutions which allow some of the surface of the container to be exposed and then re-covered again for concealing the penetration hole.

In some embodiments, the slidable member also allows opening the sealer of the can top for revealing the opening thereof to allow access to the container's content, e.g. in case of beverage can container with a press button sealer the slidable is placed over the press button and when first slid back along the tracks it also presses the button inwardly into the can cavity for opening thereof by having a section that protrudes inwardly at one end thereof.

Reference is now made to FIGS. 1A-1F showing a safety cover mechanism 100 over an upper surface 11 of a can 10 container, according to one embodiment of the invention. The safety cover mechanism 100 in this embodiment includes a slidable member 120 and two tracks 110*a* and 110*b* formed by punch pressing of the upper surface 11 part of the can 10. The slidable member 120 is inserted and slid through those tracks 110*a* and 110*b*. The can 10 may be made of aluminum or aluminum alloy or any other material known in the art for can production.

The can 10 has an opening 15 (FIG. 1E) over its upper surface 11 sealed by a press button sealer 12, which is a piece that connects to the rim of the opening 15 by a soft connection that can be easily open once applying pressure inwardly over the sealer 12.

According to some embodiments, as shown in FIGS. 1A-1E, the upper surface 11 of the can 10 may include a recess stopper 14 also formed by punch pressing, for preventing the slidable member 120 from exceeding thereof when slid through the tracks 110*a* and 110*b*.

The slidable member 120 has a protrusion 121 for comfort sliding thereof and a folded edge part 122 (see FIG. 1E) that folds inwardly towards the upper surface 11 of the can 10 for being blocked by the recess stopper 14 and also for enabling pressing the press button sealer 12 inwardly at the first opening of the can 10 when the slidable member 120 is slid thereover.

The design of the slidable member 120 over the opening of 15 of the can 10 allows revealing and covering thereof at will repeatedly by sliding the slidable member 120 back and forth over the tracks 110*a* and 110*b*.

Figure 1E:
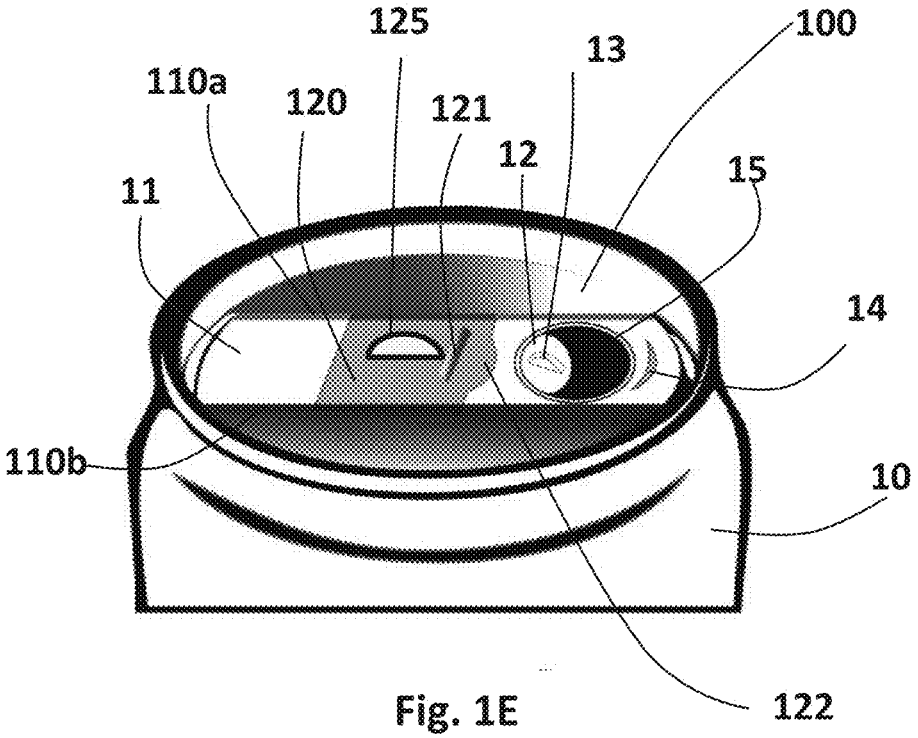

According to some embodiments, as shown in FIGS. 1A and 1E, the press button sealer 12 also has a protrusion 13 that engages the folded edge part 122 of the slidable member 120 for pressing the sealer 12 inwardly when the slidable member 120 is slid thereover. The slidable member 120 also includes an elevated niche 125 fit to interlock with the protrusion 13 when the sealer 12 is in its un-open position before opening of the can 10.

Figure 1F:
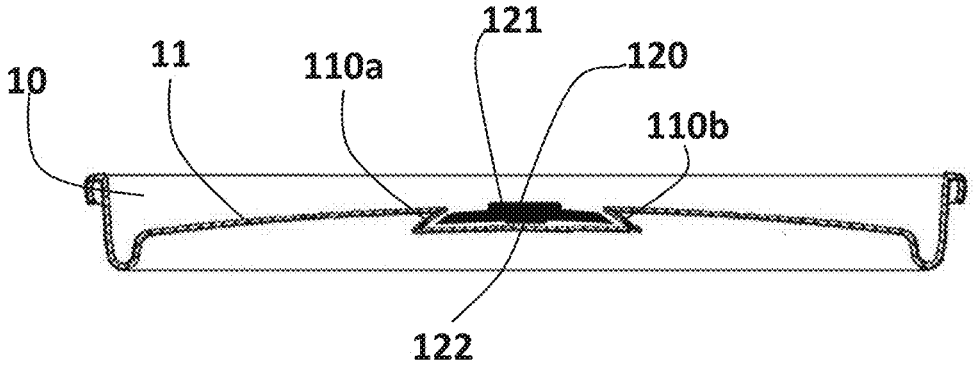

As shown in FIG. 1F, the upper surface 11 of the can 10 is convex in a substantially symmetric manner such that the highest point or area is located substantially at the center of the upper surface 11. Therefore, the tracks 110*a* and 110*b* formed over the upper surface 11 of the can 10 are also convex requiring the slidable member 120 to be configured in a corresponding curvature or be flexible enough to allow sliding thereof over the curved tracks 110*a* and 110*b*. In this way, since the opening 15 is located offset from the center of the upper surface 11, the slidable member 120 passes thereof while declining from the highest area of the upper surface 11 allowing further pressing the press button 12 inwardly thereby.

Reference is now made to FIGS. 2A-2E showing a safety cover mechanism 200 installed over an upper face 21 of a can 20 container, according to another embodiment of the invention. The safety cover mechanism 200 in this embodiment includes a slidable member 220 and two tracks 210*a* and 210*b* over which the slidable member 220 is slid. Each of the tracks 210*a* and 210*b* is either integrally or non-integrally connected over the upper surface 21 of the can 20 and may be made from any rigid or semi-rigid material known in the art such as plastic, aluminum, alloy and the like. The can 20 may be made of aluminum or aluminum alloy or any other material known in the art for can production. The slidable member 220 has a protrusion 221 for comfort sliding thereof.

Figure 2A:
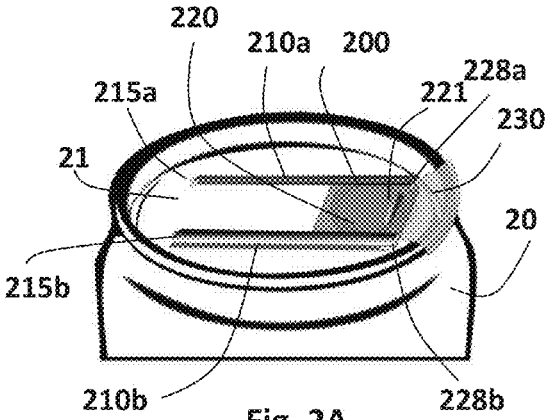
FIGS. 2A-2E schematically illustrate a safety cover mechanism for a conical can container, wherein the safety cover mechanism has a slidable member slidable over protruding tracks and a flexible sealer for sealing an opening of the can and for covering part of the can top rim that is designated for contacting the mouth of a person drinking from the can for improving hygiene, according to other embodiments of the present invention.
Figure 2B:
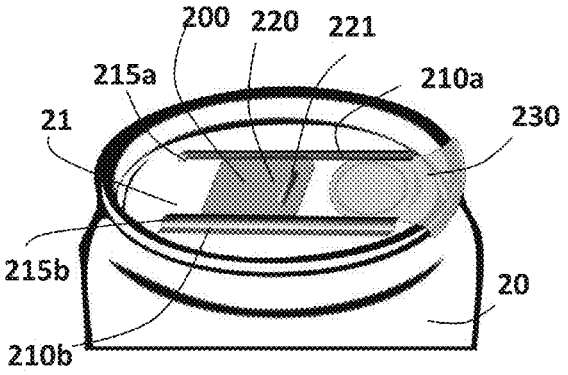
Figure 2C:
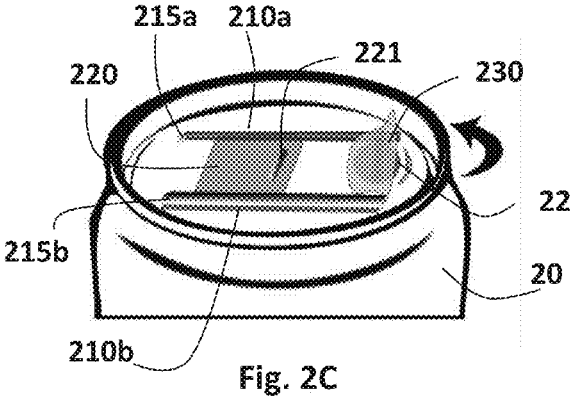
Figure 2D:
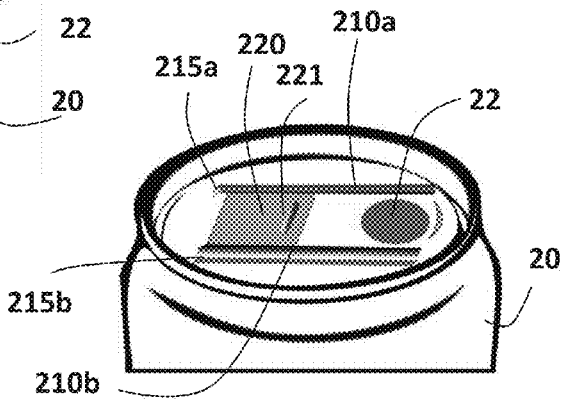

As shown in FIGS. 2A-2C, the safety cover mechanism 200 further includes a flexible sealer 230 that is attached or placed between the opening 22 of the can 20 and the slidable member 220 and serves as a sealer for the can 20 opening 22.

The flexible sealer 230 is designed to cover a portion of the top rim of the can 20 that would contact the user's mouth when drinking from the can 20. Before the first opening of the can 20 the slidable member 220 is slid backwards towards the distal rim of the can top in respect to the opening thereof and thereby also pulls the flexible sealer 230 to reveal the opening 22 flexible sealer of the can 20. Once the slidable member 220 is in a fully open position and the opening 22 is fully revealed (see FIG. 2D) the flexible sealer 230 can be removed by pulling thereof leaving only the slidable member 220 and tracks 210*a* and 210*b* over the can top side 21 for repeatable covering and revealing of the opening 22 (see FIG. 2D). Alternatively, the flexible sealer 230 is remained attached at one end thereof to the upper surface 21 of the can 20 for re-sealing of the opening 22 upon covering thereof by the slidable member 220.

The slidable member 220 has no inwardly folded portion at its edge in this embodiment and the tracks 210*a* and 210*b* edges 215*a* and 215*b* are inwardly curved to serve as stoppers for preventing the slidable member 220 from exceeding thereof when slid backwards.

Figure 2E:
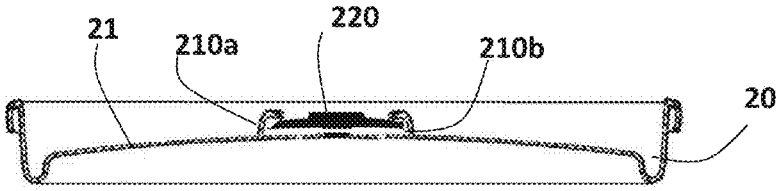

As shown in FIG. 2E, the upper surface 21 of the can 20 is convex in a substantially symmetric manner such that the highest point or area is located substantially at the center of the upper surface 21. Therefore, the tracks 210*a* and 210*b* formed over the upper surface 21 of the can 20 are also convex requiring the slidable member 220 to be configured in a corresponding curvature or be flexible enough to allow sliding thereof over the curved tracks 210*a* and 210*b*.

As shown in FIG. 2A, the safety cover mechanism 200 may also include frontal slidable stoppers such as stoppers 228*a* and 228*b* loosely attached to the slidable member 220 and covering the edges of the tracks 110*a* and 110*b*. Any slight sliding movement of the slidable member 220 backwards will cause these stoppers 228*a* and 228*b* to tear their loose holding to the slidable member 220 since they block the backwards movement thereof and since they are loosely connected thereto. This will allow identification of the sliding of the slidable member 220 for security purposes.

Reference is now made to FIGS. 3A-3F showing a safety cover mechanism 300 installed over an upper face 31 of a can 30 container, according to yet another embodiment of the invention. The safety cover mechanism in this embodiment includes a slidable member 320 and two protruding tracks 310*a* and 310*b* over which the slidable member 320 is slidable. Each of the tracks 310*a* and 310*b* connects to a rim part of the can upper surface 31. The can 30 may be made of aluminum or aluminum alloy or any other material known in the art for can production. The can 30 has an opening over its upper face 31 sealed by a press button sealer 32.

According to some embodiments, as shown in FIGS. 3A-3D, the upper face 31 of the can 30 may include a recess stopper 34 (FIG. 3C) for preventing the slidable member 320 from exceeding thereof.

The slidable member 320 has a protrusion 321 for comfort sliding thereof and a folded edge part 323 (see FIG. 3D) that folds inwardly towards the upper face 31 of the can 30 for enabling pressing the press button sealer 32 inwardly at the first opening of the can 30.

Figure 3A:
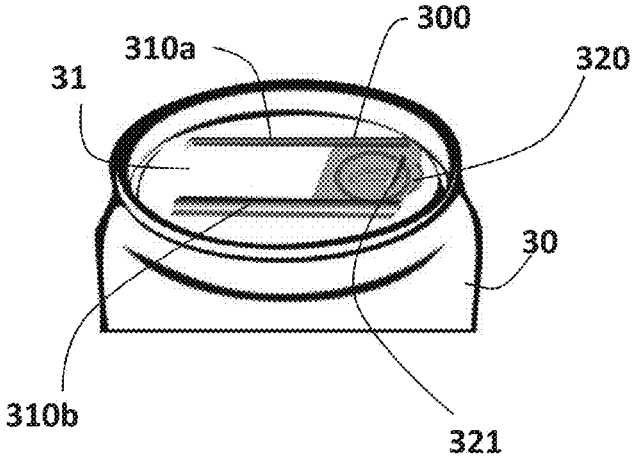
FIGS. 3A-3E schematically illustrate a safety cover mechanism for a conical can container having a press button sealer, wherein the safety cover mechanism has a slidable member slidable over protruding tracks, according to other embodiments of the present invention.
Figure 3B:
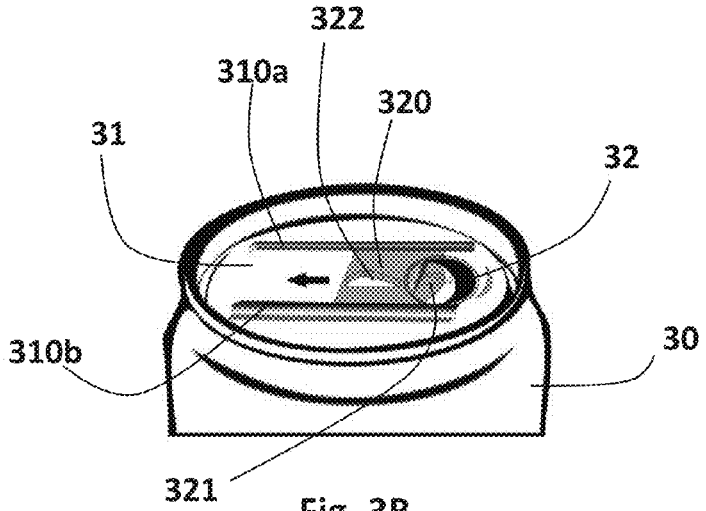
Figure 3C:
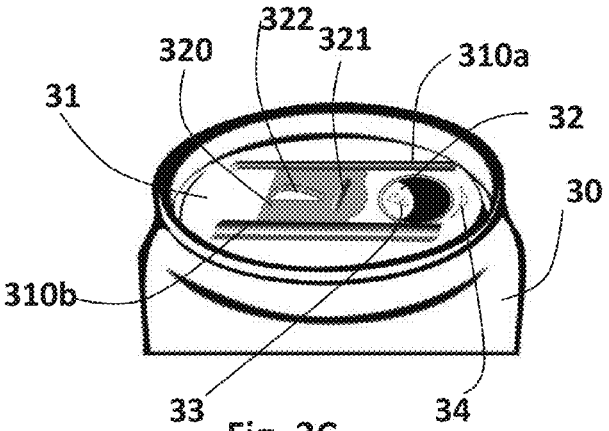
Figure 3D:
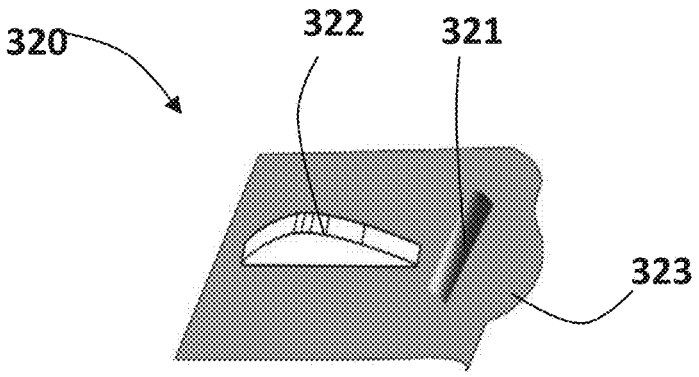

According to some embodiments, as shown in FIGS. 3A-3B, the press button sealer 32 also has a protrusion 33 that engages the folded edge part 323 of the slidable member 320 for allowing the folded edge part 323 to engage the protrusion 33 for pressing the sealer 32 inwardly towards the can 30 inner cavity.

Additionally, as shown in FIGS. 3A-3D, the slidable member 320 upper surface has an elevated niche 322 configured to interlock with the protrusion 33 of the press button sealer 32 when in its pre-open position before first opening of the can 30.

Figure 3E:
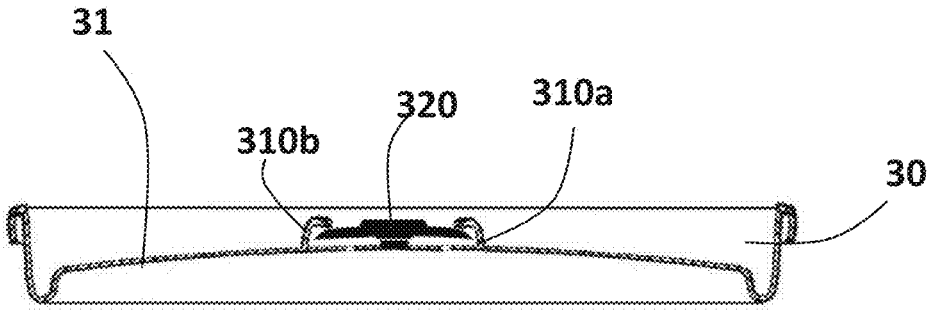

As shown in FIG. 3E, the upper surface 31 of the can 30 is convex in a substantially symmetric manner such that the highest point or area is located substantially at the center of the upper surface 31. Therefore, the tracks 310*a* and 310*b* formed over the upper surface 31 of the can 30 are also convex requiring the slidable member 320 to be configured in a corresponding curvature or be flexible enough to allow sliding thereof over the curved tracks 310*a* and 310*b*.

Reference is now made to FIGS. 4A-4E showing a safety cover mechanism installed over an upper face 41 of a can 40 container, according to yet another embodiment of the invention. The safety cover mechanism 400 in this embodiment includes a slidable member 420, a flexible sealer 430 and two tracks 410*a* and 410*b* formed by punch pressing of the upper surface 41 part of the can 40.

The can 40 has an opening 42 over its upper surface 41 sealable by the flexible sealer 430 of the safety cover mechanism 400.

The slidable member 420 has a protrusion 421 for comfort sliding thereof.

Figure 4A:
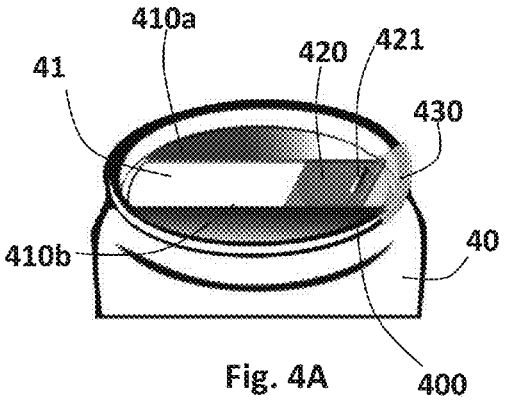
FIGS. 4A-4E schematically illustrate a safety cover mechanism for a conical can container, wherein the safety cover mechanism has a slidable member slidable over tracks formed over the can upper face and a flexible sealer for sealing an opening of the can and for covering part of the can top rim that is designated for contacting the mouth of a person drinking from the can for improving hygiene, according to other embodiments of the present invention.
Figure 4B:
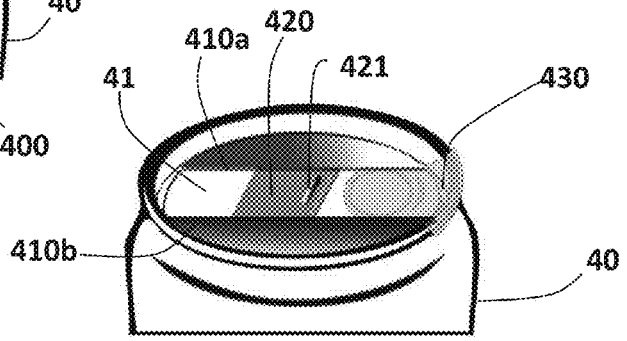
Figure 4C:
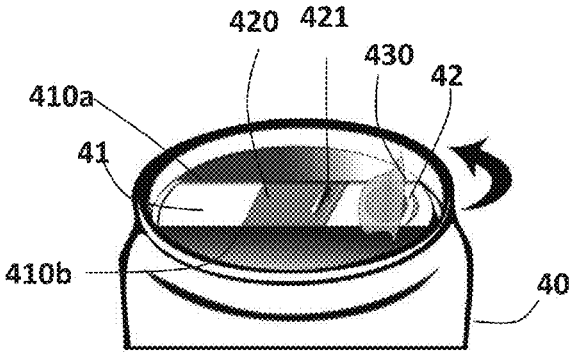
Figure 4D:
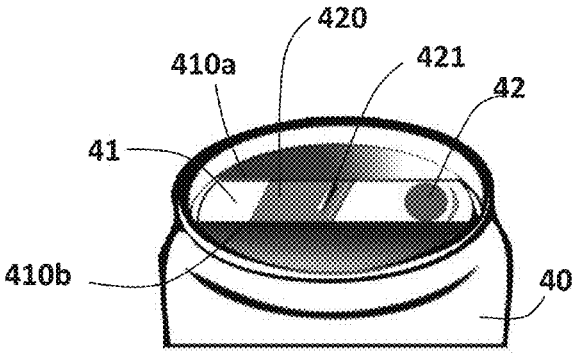
Figure 4E:
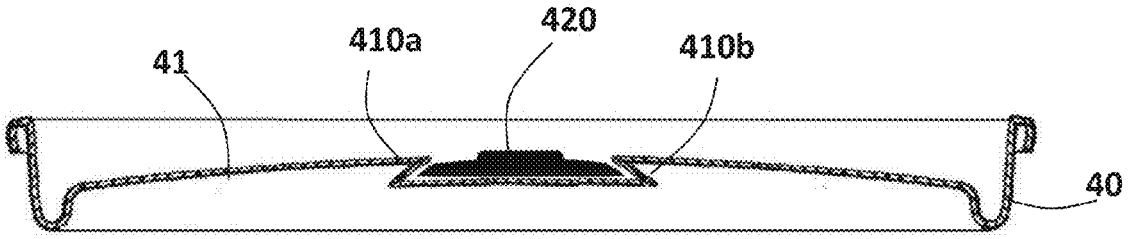

As shown in FIGS. 4A-4C, the flexible sealer 430 is attached or placed between the opening 42 of the can 40 and the slidable member 420 and serves as a sealer of the opening 42 as well as a hygiene element for preventing exposure of the part of the can 40 rim that is designated to be in contact with a user's lips during storage and transport of the can 40. The flexible sealer 430 is removable from that rim part of the can 40 only upon first opening thereof and can then be either completely removed from the can 40 or reused for re-sealing of the can opening 42 by connecting still to the can surface 41 at one end thereof.

Reference is now made to FIGS. 5A-5G, schematically illustrating a safety cover mechanism 500, according to another embodiment of the invention. In this embodiment the safety cover mechanism 500 includes a slidable member 520, two protruding tracks 510*a* and 510*b* located over the upper surface 51 of a beverage can 50 and a flexible sealer 530 having a designated sealing portion 531 that loosely connects thereto for easy opening thereof, when the slidable member 520 is slid over the tracks 510*a* and 510*b*. The tracks 510*a* and 510*b* have curved edges 515*a* and 515*b* serving as stoppers for preventing the slidable member 520 from exceeding thereof when slid opposite to the can opening 54.

Figure 5A:
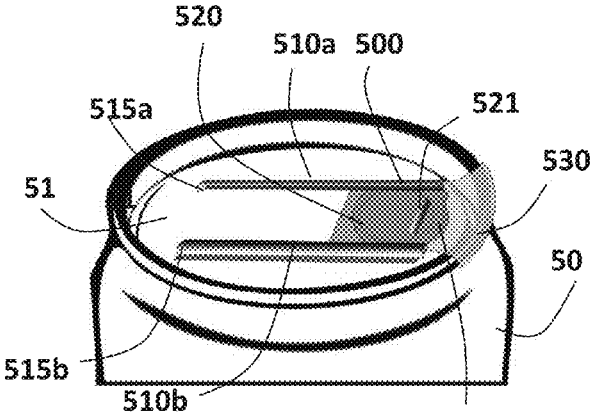
FIGS. 5A-5G schematically illustrate a safety cover mechanism for a conical can container having a flexible sealer, wherein the safety cover mechanism has a slidable member slidable over designated tracks, according to some embodiments of the present invention.
Figure 5B:
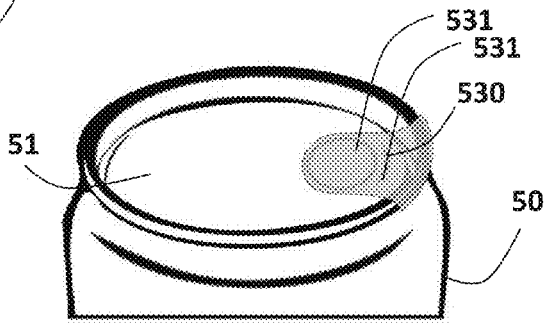
Figure 5C:
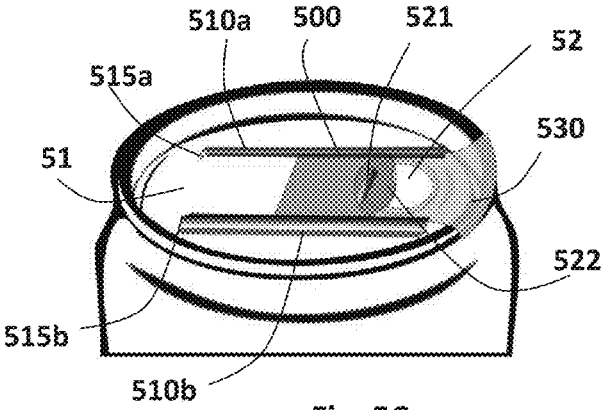
Figure 5D:
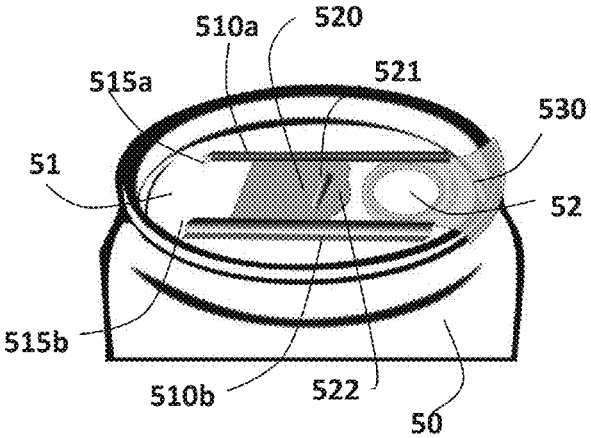
Figure 5E:
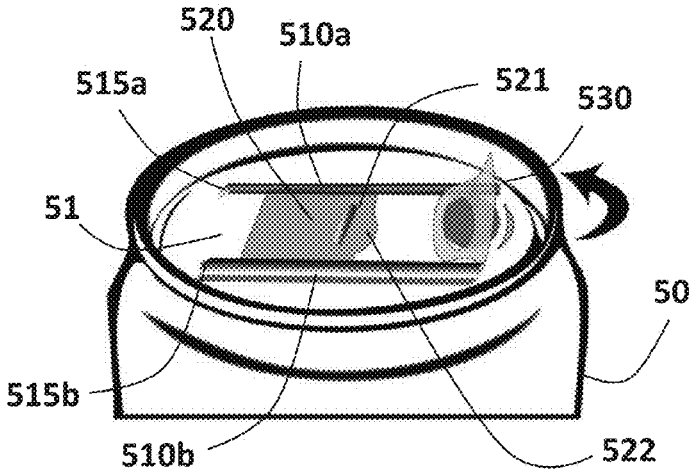
Figure 5F:
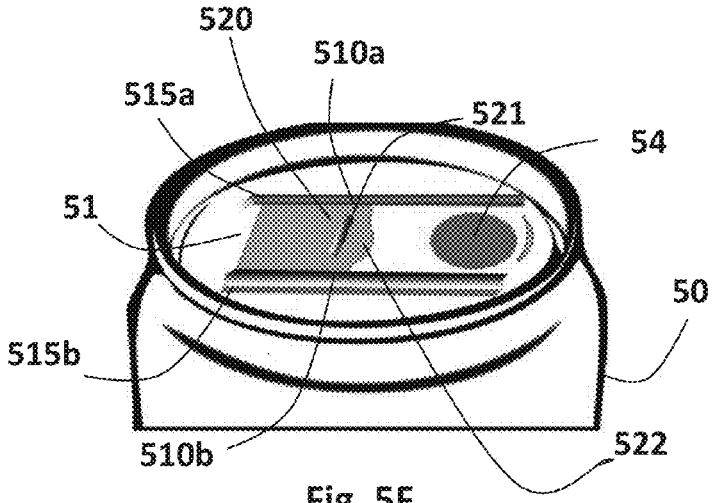
Figure 5G:
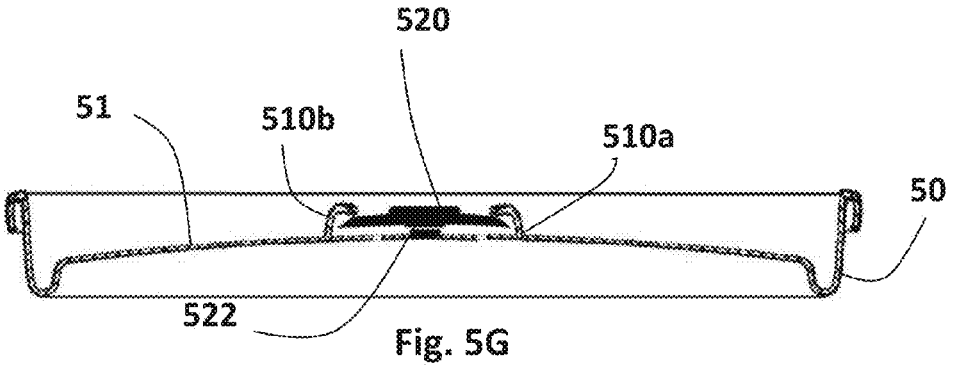

According to some embodiments, the flexible sealer 530 covers a rim portion of the can 50 designated to be in contact with a user's lips when drinking for hygienic purposes. Additionally, as shown in FIGS. 5C-5D, once the slidable member 520 is slid backwards, away from the location of the opening 54 of the can, the loosely connected portion 531 of the flexible sealer 530 tears due to the pressure applied thereover by an inwardly protruding folded edge 522 of the slidable member 520. The slidable member 520 may also include a protrusion 521 for easy sliding thereof.

The safety cover mechanism as described above or in any other embodiment of this invention is designed such that when the slidable member is even slightly slid away from the location of the opening of the container in the first opening of the container this slight sliding movement thereof will cause the sealer (either the press button sealer, flexible sealer or any other sealer design) to be at least partially unsealed in a manner that will not allow reconnecting thereof. This means that once the slidable member is slightly slid through the tracks to open, it will indicate to the user that the can was opened after the manufacturer had sealed it at least to some extent.

This configuration is targeted at preventing unauthorized penetration into the container's inner content for preventing felonious penetration of materials after the can has been sealed by the manufacturer.

The present invention further provides a safety mechanism for containers with a pull tab or a stay-on tab and a press button as an opening sealer, where the tab pivotally connects to the upper surface of the container e.g. can through a connecting element such as a stud or screw defining the tab's rotation axis. The safety mechanism comprises at least one stopper configured to prevent rotation of the pull or stay-on tab around its axis, for preventing unauthorized access to the inner cavity of the container while the sealer thereof is maintained by rotating the tab and exposing a portion of the surface that would be hidden by the tab if not rotated for penetrating into the container by punctuating the exposed portion and then hiding the penetration hole by rotating the tab back to its original position opposite the sealer.

Figure 6A:
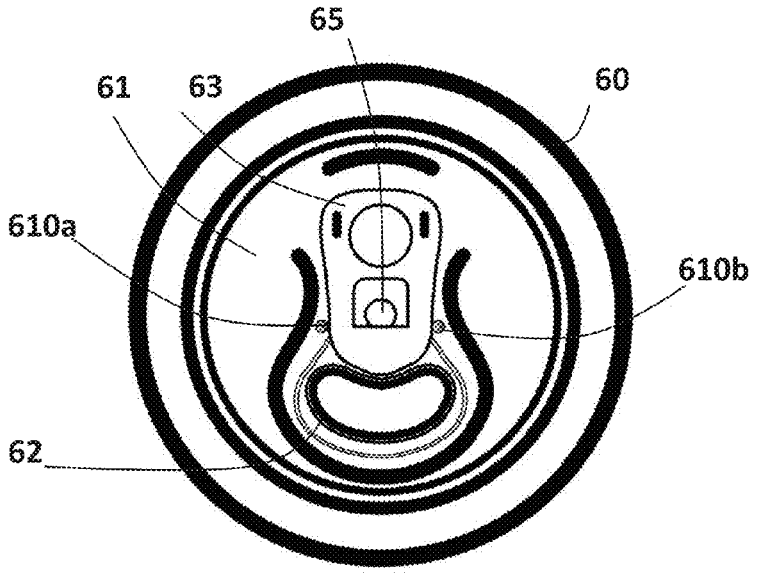
FIGS. 6A-6C show a safety mechanism for food or beverage containers such as a can, which is designed to prevent rotation of a pull or stay-on tab of the can, which includes two protrusions protruding from the can upper face and located at opposite sides of the tab, according to one embodiment of the invention.
Figure 6B:
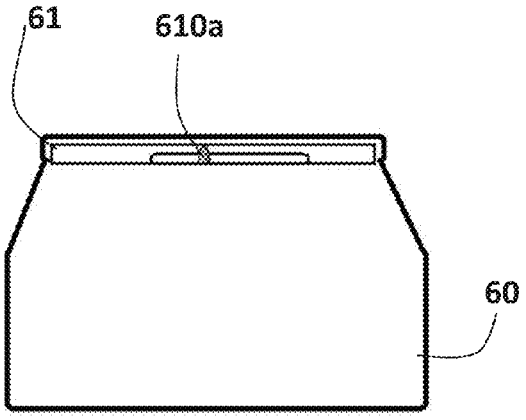
Figure 6C:
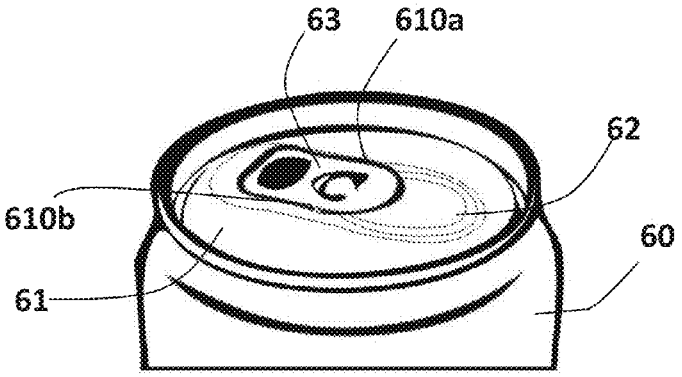

Reference is now made to FIGS. 6A-6C showing a safety mechanism for a stay-on tab closure of a can container 60, according to some embodiments. The stay-on tab closure includes a stay-on tab 63 and press button sealer 62 for sealing an opening at the upper part 61 of the can 60. The closure mechanism is stay-on tab 63 connects to the upper part 61 of the can 60 via a connecting stud or screw connector 65.

The safety mechanism includes two stoppers 610*a* and 610*b*, which protrude from the upper part 61 cover of the can 60 configured as integral part of the can upper part 61 or attached thereto.

These two stoppers 610*a* and 610*b* are positioned adjacent to sides of the stay-on tab 63 to prevent rotation of the tab 63 thereby preventing unauthorized accessing the inner cavity of the can 60 by attempting to punctuate a surface of the upper part 61 that is adjacent to the connector 65.

Figure 7:
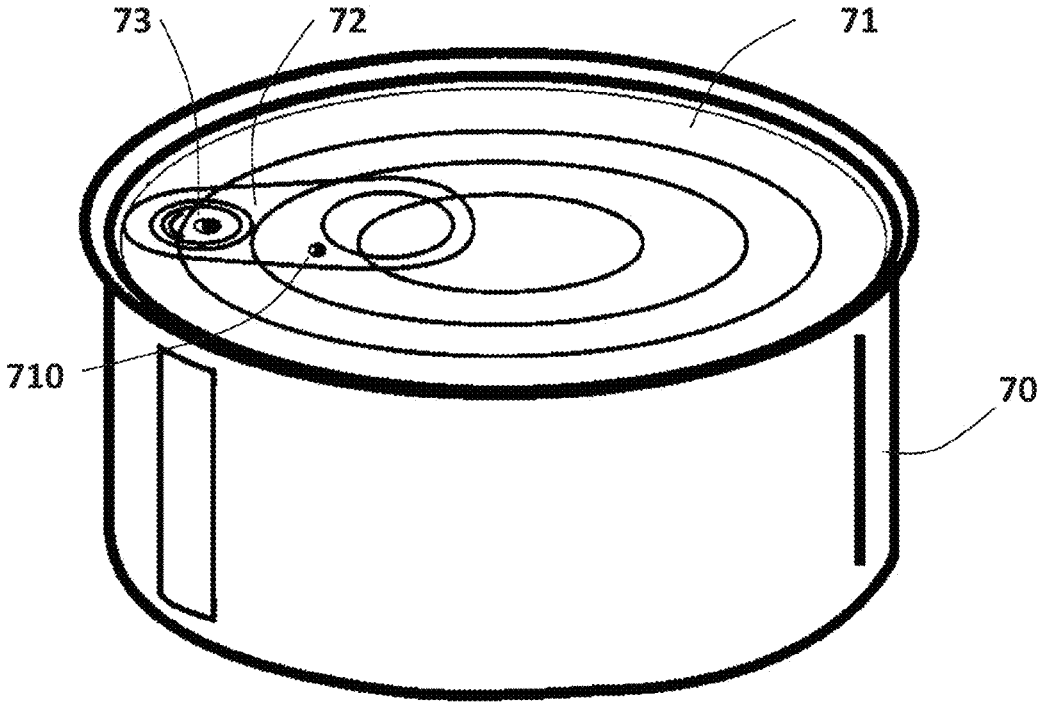
FIG. 7 shows a safety mechanism for preventing rotation of a pull tab of a can, which includes a single pin fastening the tab to the upper face part of the can, according to an alternative embodiment of the invention.

FIG. 7 shows a safety mechanism for preventing rotation of a pull tab 72 for pulling an upper face 71 of a can 70, pivotally connecting to the upper surface 71 via a stud connecting element 73. The safety mechanism includes a pin 710 located over the pull tab 72 protruding inwardly penetrating the upper surface 71 of the can 70 for connecting the pull tab 72 to the upper surface 71, according to an alternative embodiment of the invention. The connecting pin 710 is located offset from the rotation axis of the tab 72 defined by the connecting stud 73.

Figure 8:
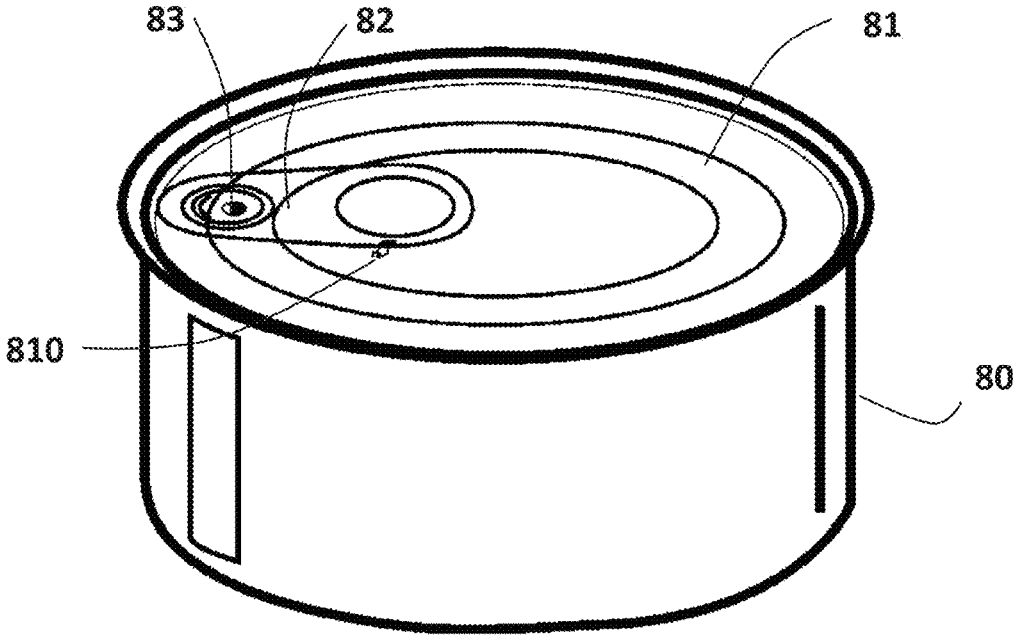
FIG. 8 shows a safety mechanism for preventing rotation of a pull tab of a can, which includes a fastener fastening the pull tab and the cover of the can, according to another embodiment of the invention.

FIG. 8 shows a safety mechanism for preventing rotation of a pull tab 82 for pulling an upper face 81 of a can 80 connected to the cover 81 via a connector 83, wherein the safety mechanism includes a fastener 810 fastening the pull tab 82 to the cover 81 of the can 80 to prevent rotation of the pull tab 82, according to another embodiment of the invention.

Figure 9:
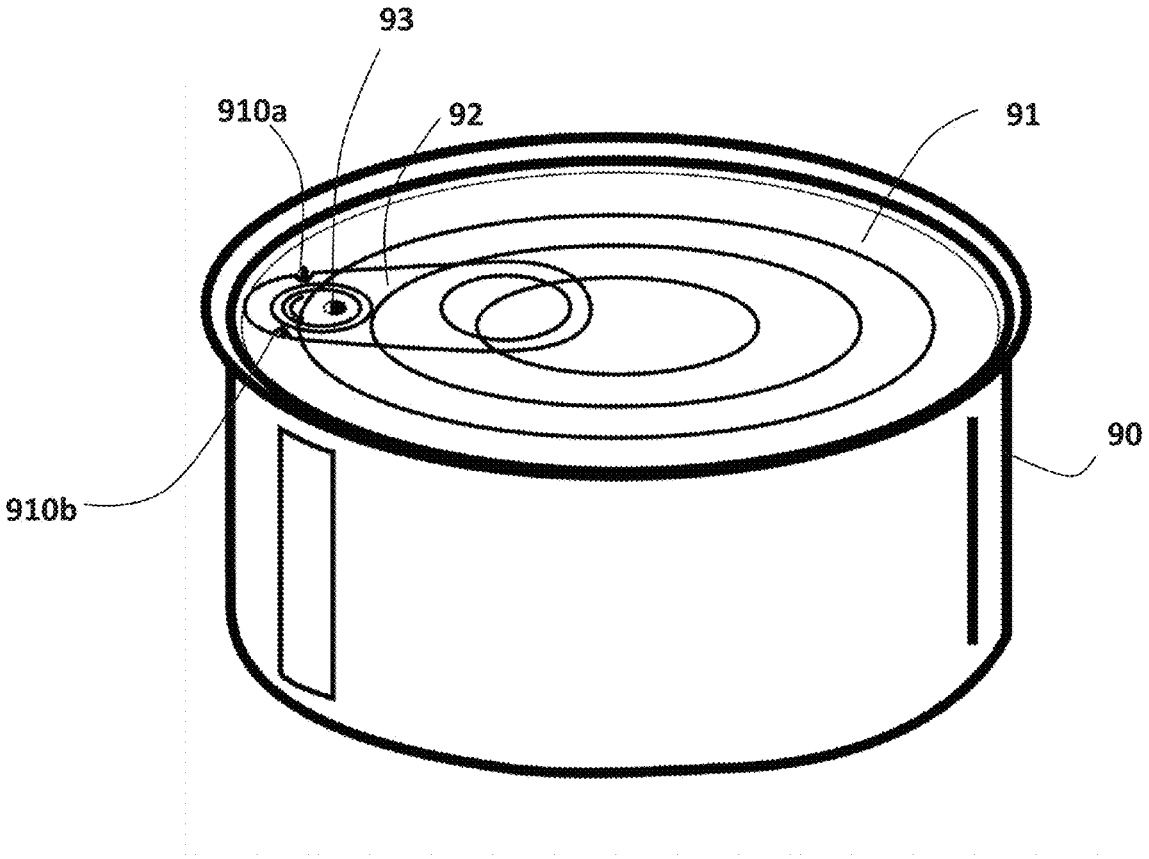
FIG. 9 shows a safety mechanism for preventing rotation of a pull tab of a can, which includes two protrusions, located at opposite sides of the pull tab, according to yet another embodiment of the invention.

FIG. 9 shows a safety mechanism for preventing rotation of a pull tab 92 for pulling an upper face 91 of a can 90 connected to the cover 91 via a connector 93, wherein the safety mechanism includes two protrusions 910*a* and 910*b* located adjacent to the pull tab 92 adjacent to opposite sides thereof for preventing rotation of the pull tab 92, according to yet another embodiment of the invention. The protrusions 910*a* and 910*b* may be integrally connected to the can upper face 91 or separately connected thereto. As shown in FIG. 8, the pull tab 82 is designed such that it has two recesses for fitting the stopper protrusions 810*a* and 810*b* therein.

The slidable member of the safety mechanisms of the present invention may also be used for covering and optionally also sealing the opening formed after the can top sealer (e.g. the push button or flexible sealer foil) is opened for allowing the user of the container to re-seal it for continuous use.

References is now made to FIGS. 10A-10D, which show a can top 1000 with a safety mechanism for a container such as a beverage can or parts of the mechanism. The can top 1000 has a can top member 1200 and a slidable member 1100, wherein the slidable member 1100 thereof also allows re-sealing the can opening after its press button sealer 1210 has been opened, wherein the post-opening sealing is done by adding a sealing strip 1150 such as a silicone strip to the periphery bottom edge 1130 of the slidable member 1120, according to some embodiments of the invention.

Figure 10A:
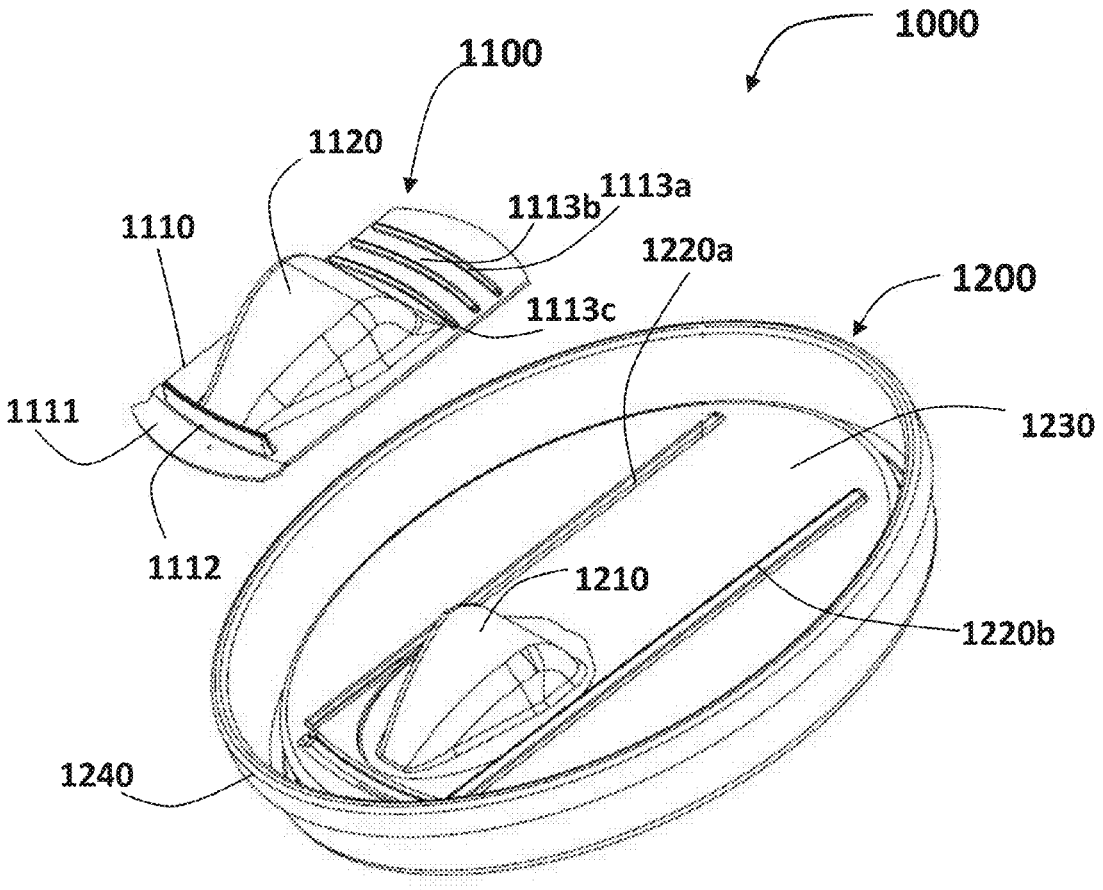
FIGS. 10A-10D show a can top with a safety mechanism for a container such as a beverage can, which also allows sealing the can opening after its press button sealer has been opened, wherein the post-opening sealing is done by adding a sealing strip such as a silicone strip to the bottom edge of the slidable member, according to some embodiments of the invention.
Figure 10B:
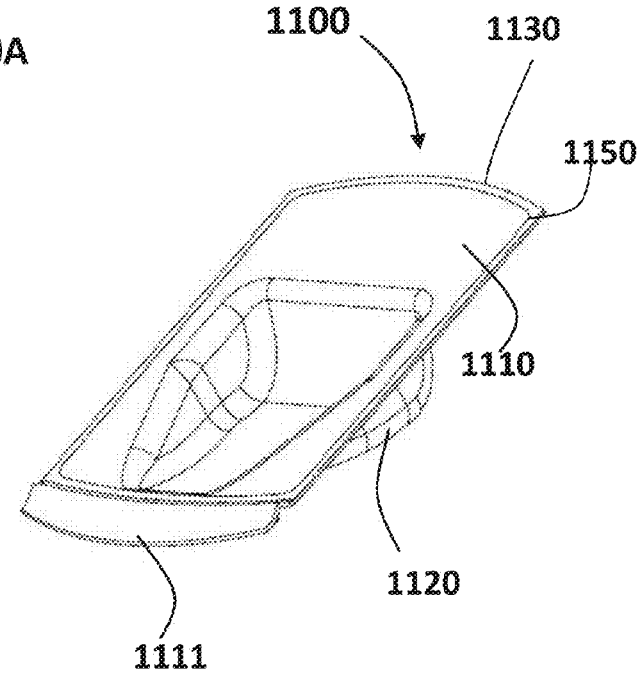
Figure 10C:
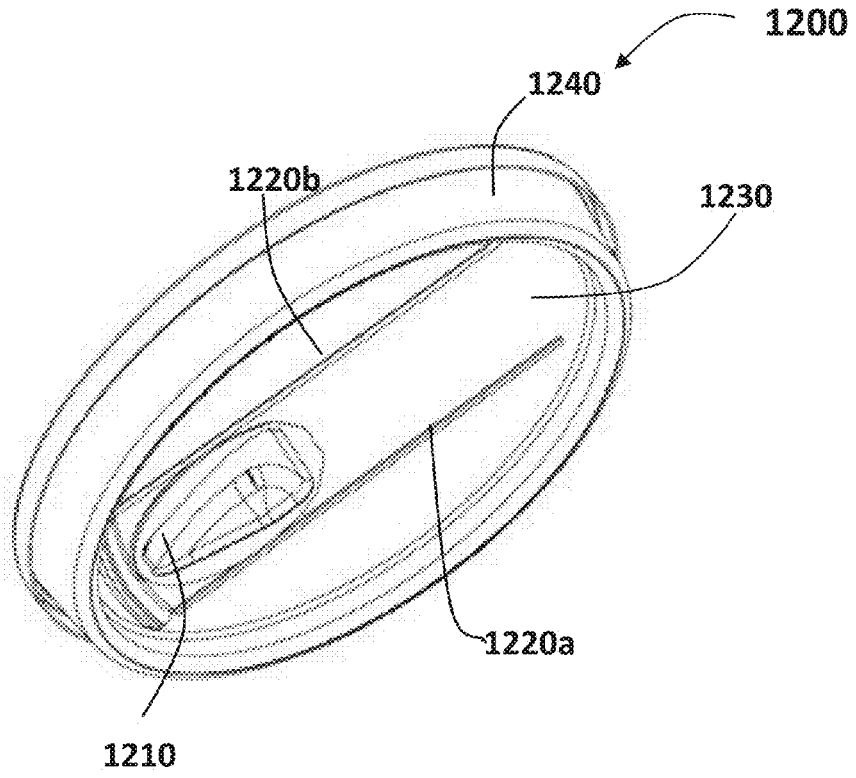

According to some embodiments of the invention, as shown in FIGS. 10A-10C, the can top member 1200 of the can has a protruding rim 1240 and an upper face 1230 integrally connected thereto, wherein the upper face 1230 is punched such as to form thereover tracks 1220*a* and 1220*b* and has an openable sealer 1210 with a sloped configuration protruding from the surface of the upper face 1230 and connected thereto through a weak connection allowing easy opening thereof.

The slidable member 1100 has a sloped protrusion 1120 that corresponds in shape and size to the sealer 1210 protruding from a base 1110 thereof, such that when slid backwards for opening of the sealer 1210 it will push the sealer 1210 inwardly into the can interior for opening thereof. The sliding of the slidable member 1100 for this initial opening of the can will cause the sealer 1210 to partially tear from its connection to the can upper face 1230 forming an opening thereover.

This opening formed by the unsealing of the sealer 1210 can be recovered and re-sealed by the slidable member 1100 simply by sliding thereof back to its initial position over the opening formed.

The slidable member 1100 bottom side periphery 1130 or part thereof is coated or added with a sealing material strip 1150 such as silicone or rubber or a coating layer strip that will increase sealing properties of the slidable member 1100 by increasing the contact area between this periphery area 1130 and the inner side of the tracks 1220*a*and 1220*b*.

The can top member 1000 and safety mechanism thereof may be entirely made from the same can material except for the sealing strip 1150 such as aluminum or aluminum alloy and the like, where all its protrusions and niches and curvatures are produced through punching.

The slidable member 1100 may also include one or more gripping protrusions such as protruding stripes 1113*a*-1113*c* (which may be produced via punching thereof) and/or a protrusion 1112 for easy pushing or pulling of the slidable member 1100 backwards for opening and unsealing of the can for accessing its content. The front edge 1111 of the slidable member 1100 may extend from this frontal protrusion 1112.

The slidable member 1100 can be used as a cover and sealer of the opening by simply sliding thereof over the formed opening of the can top 1000 where the sealing strip 1150 thereof will contact (engage) the tracks 1220*a* and 1220*b* and the upper surface 1230 other parts for sealing the opening from all periphery sides of the slidable member 1100.

The slidable member 1100 can be produced separately from the can top member 1200 and then combined by, for example, bending the slidable member 1100 inwardly or outwardly for insertion thereof into the tracks 1220*a* and 1220*b*. After the entire can top 1000 is assembled, the can top 1000 can be connected (e.g. pressed) to the can container body after it has been filled with its content such as beverage, foodstuff and the like, as typically done in can manufacturing.

FIGS. 11A-11F show a can top 2000 with a safety mechanism for a container such as a beverage can having a can top member 2200 and slidable member 2100, which also allows sealing the can opening after its press button sealer 2210 has been opened, wherein the post-opening sealing is enabled by the configuration of the slidable member 2100 periphery 2115 having a curved shape fit to engage the tracks 2220*a* and 2220*b* of the can top member 2200 upper surface 2230.

As mentioned above, the can top member 2200 has a protruding rim 2240 connecting to the can top upper surface 2230, in which tracks 2220*a* and 2220*b* are located, e.g. formed via punching their shape through the upper surface 2230 of the can top member 2200.

The can top member 2200 also includes a sloped press button sealer 2210 similar in function and configuration to the sealer 1210 and fitted in shape and size to the sloped protrusion 2120 of the slidable member 2100. The slidable member 2100 has protruding stripes 2113*a*-2113*c* and frontal protrusion 2112 and frontal edge portion 2111 similar to those of slidable member 1100.

Figure 10D:
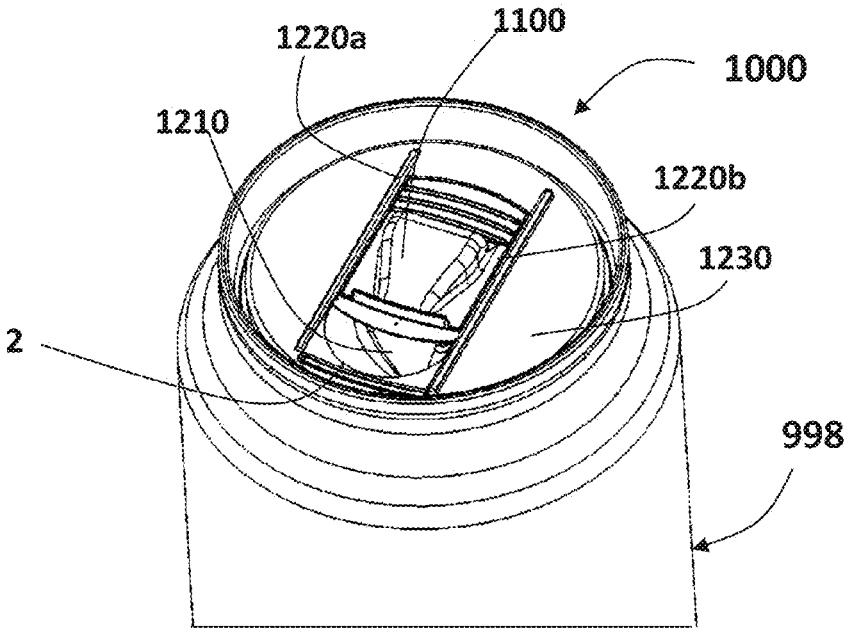

As shown in FIG. 10D, when the slidable member 1110 is slid backwards it will cause the sealer 1210 to open downwardly inwardly into the can thereby forming an opening 2 over the can top member 1200 for accessing material inside the can container 998 due to the complimentary sloped shapes of the sealer 1210 and slidable member 1110. To reseal the opening 2 that is formed by the unsealing of the sealer 1210, the slidable member 1110 should simply be slid forward back to its initial position over the opening 2, while its sealing properties (e.g. the sealing material strip in this case) will prevent the material inside the can 988 from exiting, spilling, pouring etc.

Figure 11A:
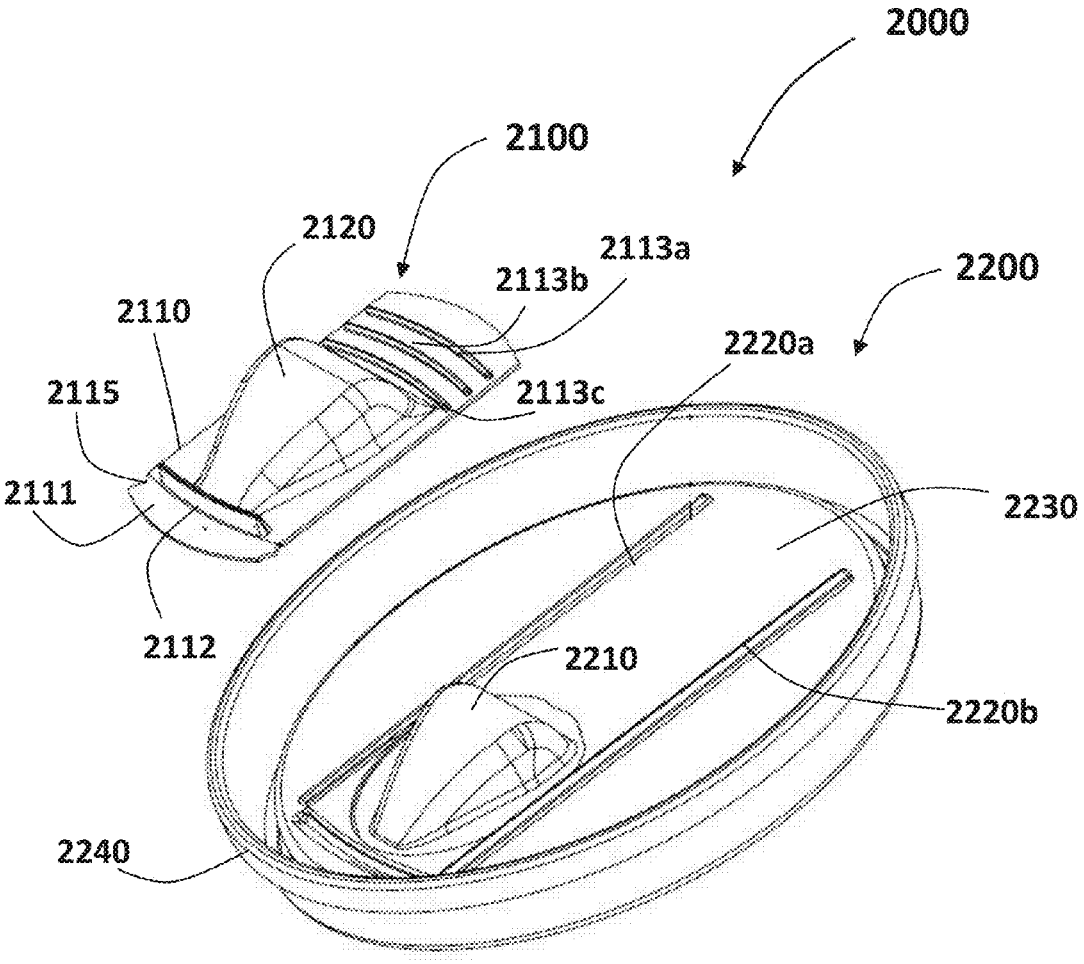
FIGS. 11A-11F show a can top with a safety mechanism for a container such as a beverage can, which also allows sealing the can opening after its press button sealer has been opened, wherein the post-opening sealing is enabled by the configuration of the slidable member edges having a curved shape fit to mesh and contact the tracks through at least a meshing and contacting line or surface, according to other embodiments of the invention.
Figure 11B:
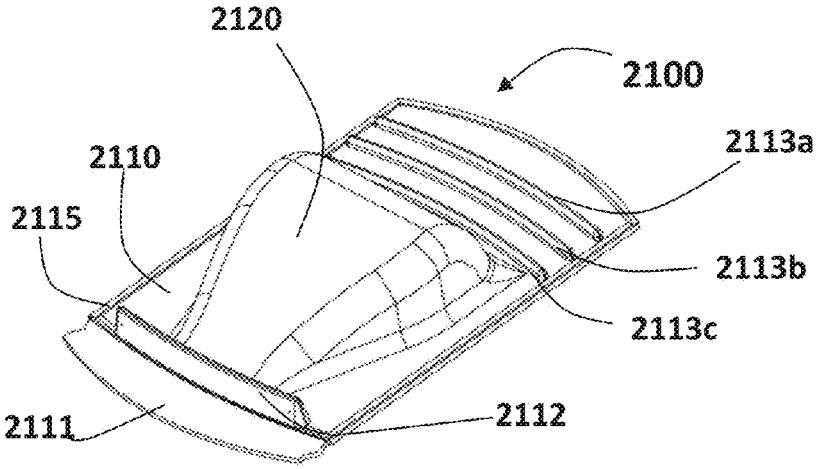
Figure 11C:
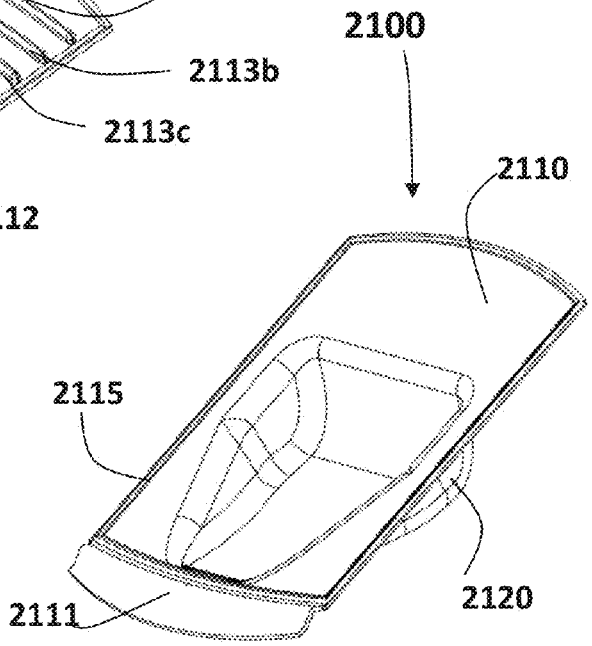
Figure 11D:
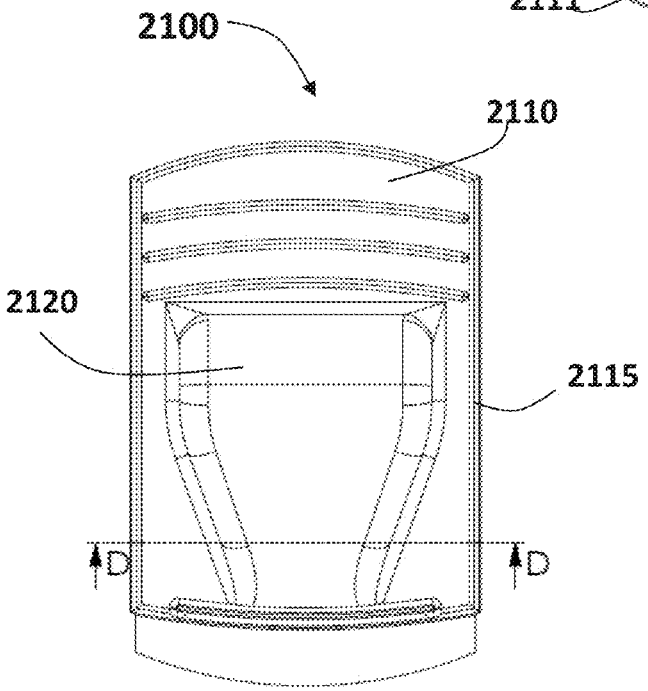
Figure 11E:
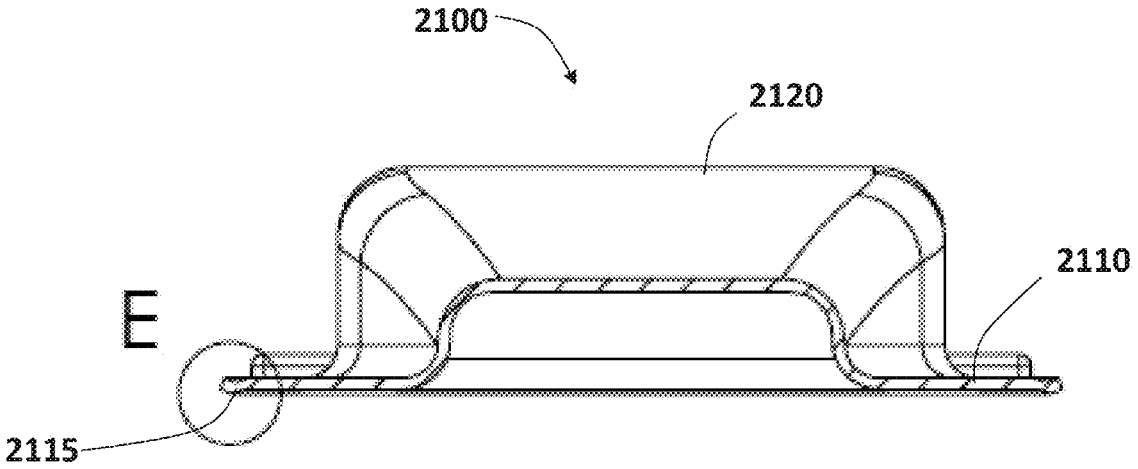
Figure 11F:
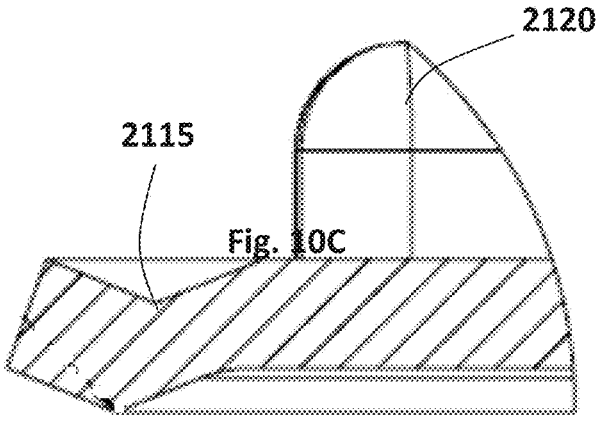
Figure 11G:
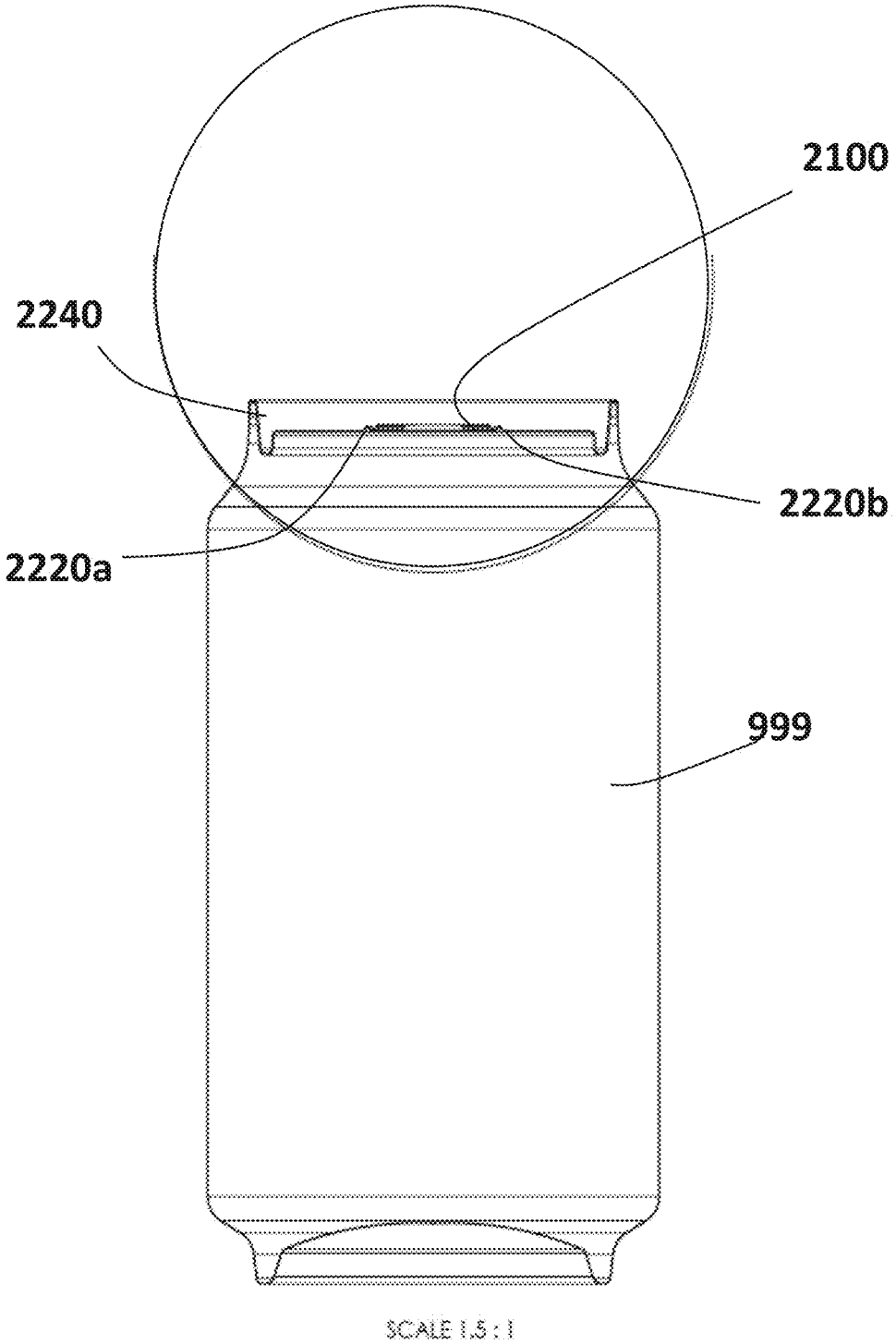
FIG. 11G shows a cross sectional view of the entire beverage can with the safety mechanism thereof.
Figure 11H:
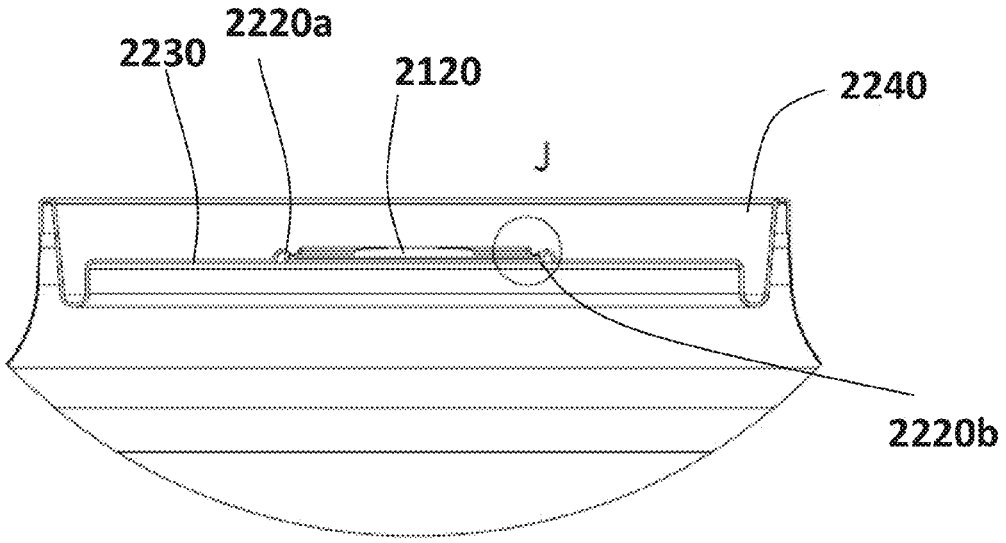
FIG. 11H shows a zoom-in area I of the can with safety mechanism shown in FIG. 11H.
Figure 11I:
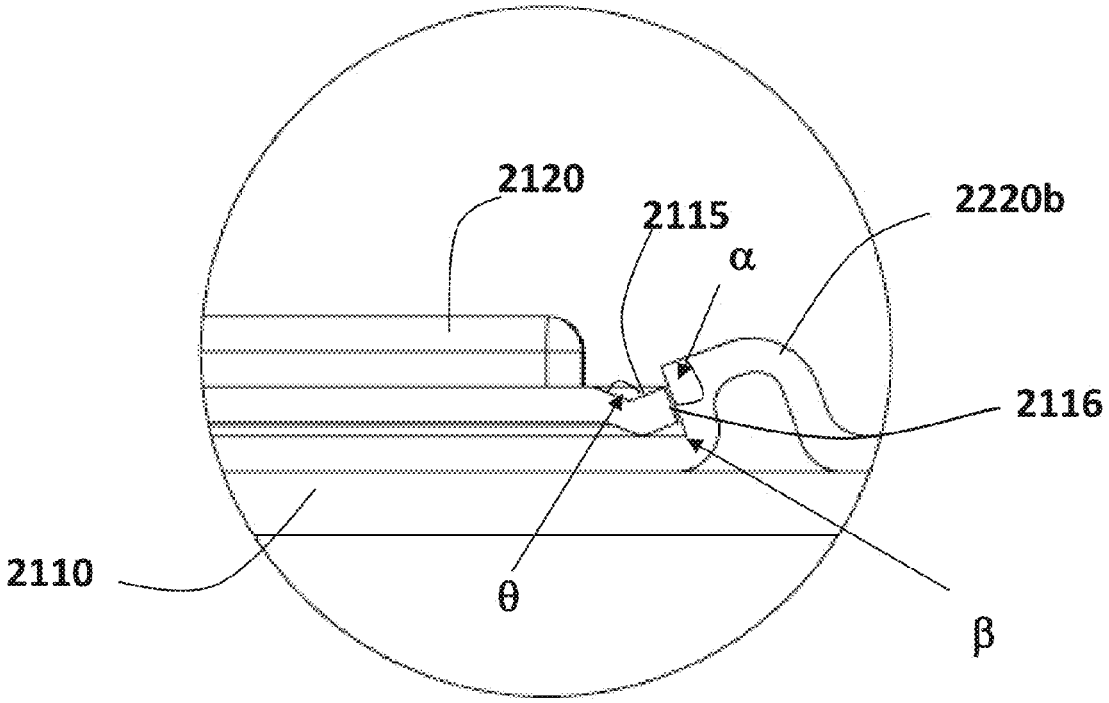
FIG. 11I shows a zoom-n view of area J indicated in FIG. 11H.

As illustrated in FIGS. 11E and 11F and also in FIGS. 11H and 11I, the curved periphery 2115 of the slidable member 2100 base 2110 is fit to be inserted to the tracks 2220*a* and 2220*b* at sides thereof and to the front and rear sides of the can top surface 2230 such as to have at least a periphery line or a surface of the slidable member 2100 in contact with the surface 2230 of the can top for sealing thereof when positioned over the opening formed by unsealing of the sealer member 2210.

As indicated in FIG. 11I, the angles "α" (ALPHA) and "β" defining shape and curvature of the tracks 2220*a* or 2220*b* and the angle "θ" (THETA) may be such that the outer wall 2116 of the slidable member 2100 periphery 2115 contact in full the inner walls of the tracks 2220*a*/2220*b* for sealing thereof. In this particular example of FIG. 11I α=90 degrees.

As mentioned above in regards to the embodiments illustrated in FIGS. 10A-10C, the can top member 2200 can be separately manufactured from the slidable member 2100 and then the slidable member 2100 can be inserted through the can top tracks 2220*a* and 2220*b* for assembling thereof. Once the slidable member and can top are assembled they can be attached to the can body 999 containing the beverage or any other material therein.

According to some embodiments of the invention the outer wall 2116 can also be coated with a sealing material or connected to a sealing material strip such as a silicone strip to further enhance the sealing properties thereof.

The safety mechanism of the present invention can be used and integrated to any container type top and not just specifically to a can container. For example, a box, a package and the like containing therein any type of material in any state liquid, gas or solid (powder etc.). Embodiments of the safety and sealing mechanism described above may be integrated onto the container top or added on thereto by adding on the tracks and slidable member.

Many alterations and modifications may be made by those having ordinary skill in the art without departing from the spirit and scope of the invention. Therefore, it must be understood that the illustrated embodiment has been set forth only for the purposes of example and that it should not be taken as limiting the invention as defined by the following invention and its various embodiments and/or by the following claims. For example, notwithstanding the fact that the elements of a claim are set forth below in a certain combination, it must be expressly understood that the invention includes other combinations of fewer, more or different elements, which are disclosed in above even when not initially claimed in such combinations. A teaching that two elements are combined in a claimed combination is further to be understood as also allowing for a claimed combination in which the two elements are not combined with each other, but may be used alone or combined in other combinations. The excision of any disclosed element of the invention is explicitly contemplated as within the scope of the invention.

The words used in this specification to describe the invention and its various embodiments are to be understood not only in the sense of their commonly defined meanings, but to include by special definition in this specification structure, material or acts beyond the scope of the commonly defined meanings. Thus if an element can be understood in the context of this specification as including more than one meaning, then its use in a claim must be understood as being generic to all possible meanings supported by the specification and by the word itself.

The definitions of the words or elements of the following claims are, therefore, defined in this specification to include not only the combination of elements which are literally set forth, but all equivalent structure, material or acts for performing substantially the same function in substantially the same way to obtain substantially the same result. In this sense it is therefore contemplated that an equivalent substitution of two or more elements may be made for any one of the elements in the claims below or that a single element may be substituted for two or more elements in a claim. Although elements may be described above as acting in certain combinations and even initially claimed as such, it is to be expressly understood that one or more elements from a claimed combination can in some cases be excised from the combination and that the claimed combination may be directed to a sub-combination or variation of a sub-combination.

Insubstantial changes from the claimed subject matter as viewed by a person with ordinary skill in the art, now known or later devised, are expressly contemplated as being equivalently within the scope of the claims. Therefore, obvious substitutions now or later known to one with ordinary skill in the art are defined to be within the scope of the defined elements.

The claims are thus to be understood to include what is specifically illustrated and described above, what is conceptually equivalent, what can be obviously substituted and also what essentially incorporates the essential idea of the invention.

Although the invention has been described in detail, nevertheless changes and modifications, which do not depart from the teachings of the present invention, will be evident to those skilled in the art. Such changes and modifications are deemed to come within the purview of the present invention and the appended claims.

The invention claimed is:

1. A container top comprising:

a container top member comprising two parallel tracks on an upper surface thereof and a sealer sealing an opening thereof; and a slidable member having a periphery that engages inner walls of the tracks and slidable through said tracks, wherein sliding of the slidable member through said tracks to one direction unseals said sealer, exposing the opening in the container top member, and sliding the slidable member back to its original position covers and seals said opening, wherein the periphery comprises a compressible sealing material strip.

2. The container top according to claim 1, wherein said periphery is curved, and wherein the inner walls of the tracks incline towards the slidable member, such that the inclination of the inner walls engages the edge of the curved periphery.

3. The container top according to claim 1, wherein said sealing material strip is a silicone or rubber strip.

4. The container top according to claim 1, wherein said sealer has a sloped shape protruding vertically upwards from the surface of the container and said slidable member has a complementary sloped, protruding shape configured to fit said sealer and covering the sealer in the initial sealed position and wherein the horizontal motion of sliding the slidable member through said tracks to one direction unseals said sealer by pushing the sloped protrusion of the sealer inwardly towards the interior of the container.

5. The container top according to claim 4, wherein said slidable member further comprises at least one protruding stripe for pushing or pulling the slidable member.

6. The container top according to claim 1, wherein said tracks and sealer are produced through punch pressing.

7. The container top according to claim 1, wherein at least one track curves at least one edge thereof to prevent the slidable member from exceeding the track curved edge.

8. The container top according to claim 1, wherein said sealer is a press button sealer configured for sealing the opening of the container by loosely and integrally connecting to the edges of said opening.

9. The container top according to claim 1, wherein said container top is configured for sealably attaching thereof to a container body containing a material therein.

10. A sealing and safety mechanism for a can container positionable over a container top, said mechanism comprising:

two parallel tracks positioned on an upper surface of the container top;

a sealer sealing an opening over the container top; and a slidable member having a periphery that engages inner walls of the tracks and is slidable through said tracks, wherein sliding of the slidable member through said tracks to one direction unseals said sealer, exposing the opening in the container top member, and sliding the slidable member back to its original position covers and seals said opening, wherein the periphery comprises a compressible sealing material strip.

11. A container top comprising:

a container top member comprising two parallel tracks on an upper surface thereof and a sealer sealing an opening thereof; and a slidable member having a periphery that engages inner walls of the tracks and is slidable through said tracks wherein sliding of the slidable member through said tracks to one direction unseals said sealer, exposing the opening in the container top member, and sliding the slidable member back to its original position covers and seals said opening;

wherein said sealer has a sloped shape protruding vertically upwards from the surface of the container and said slidable member has a complementary sloped, protruding shape configured to fit said sealer and covering the sealer in the initial sealed position and wherein the horizontal motion of sliding the slidable member through said tracks to one direction unseals said sealer by pushing the sloped protrusion of the sealer inward towards the interior of the container.

* * * * *